United States Patent [19]

Graham

[11] 4,317,285

[45] Mar. 2, 1982

[54] BRUSH CUTTING ATTACHMENT FOR CHAIN SAW

[76] Inventor: William W. Graham, 1275 Castlehill Crescent, Ottawa, Ontario, Canada, K2C 2B2

[21] Appl. No.: 247,720

[22] Filed: Mar. 26, 1981

Related U.S. Application Data

[63] Continuation-in-part of Ser. No. 115,354, Jan. 25, 1980, Pat. No. 4,270,272.

[51] Int. Cl.[3] ..... B27B 17/02

[52] U.S. Cl. ..... 30/371; 30/382

[58] Field of Search ..... 30/371, 372, 382, 383, 30/384, 166 R; 83/745

[56] References Cited

U.S. PATENT DOCUMENTS

| | | | |
|---|---|---|---|
| 2,642,901 | 6/1953 | Hayden | 30/371 |
| 2,698,034 | 12/1954 | Jakku | 30/371 |
| 2,797,717 | 7/1957 | Budd | 30/371 |
| 2,925,105 | 2/1960 | Hayden | 30/371 |
| 2,930,416 | 3/1960 | Granberg | 30/371 |
| 3,540,500 | 11/1970 | Greene | 30/382 |
| 3,931,676 | 1/1976 | Merle | 30/371 |
| 4,193,193 | 3/1980 | Holzworth | 30/382 |

*Primary Examiner*—Jimmy C. Peters

*Attorney, Agent, or Firm*—Berman, Aisenberg & Platt

[57] ABSTRACT

An attachment for a direct drive gasoline or electric powered chain saw for delimbing, thinning, pruning and brushing. The attachment comprises a rigid bar of round cross-section which is secured to the blade of a chain saw at a point spaced a short distance towards the handle from the tip of the blade. When so secured, the bar has a straight portion traversing the flat of the blade at an angle to the longitudinal axis of the blade, extending forwardly and downwardly with respect thereto and upwardly and rearwardly beyond the upper edge of the blade. The bar lies substantially in a plane parallel to the plane of the blade. A second portion of the bar projects beyond the lower edge of the blade and is bent in a gradual curve through an arc radiaus so that its end is parallel to the longitudinal axis of the blade. The bar is secured to the flat of the blade by an appropriate securing device and is preferably spaced from the surface of the blade. A kickback guard is also secured to the attachment to shield the upper front cutting surface of the chain saw from operative engagement with material to be cut. The attachment provides an effective means for cradling small branches and the like to steady them while being cut while at the same time reducing kickback of the chain saw or damage to adjacent foliage or vegetation.

17 Claims, 3 Drawing Figures

BRUSH CUTTING ATTACHMENT FOR CHAIN SAW

This is a continuation-in-part of U.S. Patent Application No. 06/115,354, filed Jan. 25, 1980 and allowed Nov. 25, 1980 now U.S. Pat. No. 4,270,272, issued June 2, 1981.

BACKGROUND OF THE INVENTION

This invention relates to an attachment for a direct drive gasoline or electric powered portable chain saw, and more particularly relates to an attachment for such a chain saw for delimbing, thinning, pruning and brushing.

Several problems arise when a portable chain saw is put to use for which it was not primarily designed, for example, for cutting wood of relatively small diameter (e.g. two inches or less). In addition to the ever present danger of kickback, it may be difficult to hold a sapling or small branch steady to enable the teeth of the chain to cut. Moreover, when using a chain saw in brush or closely spaced trees, there is a difficulty in accurately cutting without damaging adjacent brush or trees.

To facilitate such operations, straight prongs, of flat cross-section secured to the flat of the blade at varied locations thereon, and protruding therefrom in various orientations have been proposed in the past. A prong extending forwardly parallel to the longitudinal axis of the chain saw blade is described and illustrated in Robinson U.S. Pat. No. 3,680,607 issued Aug. 1, 1972; a prong protruding diagonally, laterally from a middle location along the length of the saw blade is described and illustrated in Graves, et al Canadian Pat. No. 585,268 issued Oct. 20, 1959; a similar type of prong, positioned towards the front tip of adjacent chain saw blade is described and illustrated in Canadian Pat. No. 524,343 of Budd issued Apr. 24, 1956. Haddan U.S. Pat. No. 2,925,105 issued Feb. 16, 1960 describes and illustrates a straight, flat prong for either central or tip positioning on a blade, the angle of which is adjustable. The prong has two spaced sides, the chain of the saw passing through a space between the sides. Multiple blade attachments are described and illustrated in Hayden U.S. Pat. No. 2,642,901 issued June 23, 1953 and Jakku U.S. Pat. No. 2,698,034 issued Dec. 28, 1954.

While such prior art devices may be effective for limited purposes, their applications are restricted by the angle of the prong, the location and orientation in which the prong is attached to the blade, and the construction of the prong itself. For example the space between the double sided prong, between which the chain runs, would permit brush to build up and become clogged therein if it were used for brush cutting or cutting of other relatively fine vegetation. Some prior art devices provide an attachment means to the blade which has a front edge surface positioned normal to the longitudinal axis of the blade. This creates an abuttment to material being cut to prevent such material from passing freely over and beyond the blade. In operations using most of these devices there is no physical means to limit the size of material being cut and, during cutting, mechanical guiding of the material being cut is either partial or absent. Finally, with the vibration involved in operating a chain saw particularly in confined quarters when pruning or the like, the flat prongs of such prior art devices provide a sharp edge which may rub against adjacent foliage and cut or damage such foilage during the cutting operation.

It is an object of the present invention to provide a chain saw attachment which will be versatile in enabling the chain saw to effectively delimb, thin and prune foliage over a wide range of conditions and sizes. It is a further object of the present invention to provide such an attachment which will enable such activity to be carried out with minimal damage to adjacent foliage.

SUMMARY OF THE INVENTION

The invention comprises an attachment for a portable direct drive gasoline or electric powered chain saw, the attachment comprising a rigid bar of round cross-section to be secured to the blade at a point spaced a short distance towards the handle from the tip of the blade. The bar, when so secured, has a straight portion traversing the flat of the blade at an angle to the longitudinal axis of the blade forwardly and downwardly extending with respect thereto and upwardly and rearwardly beyond the upper edge of the blade. The bar lies substantially in a plane parallel to the plane of the blade. A second portion of the bar projects beyond the lower edge of the blade, this portion being gradually curved through an arc so that its end is parallel to the longitudinal axis of the blade. The bar is secured by appropriate means to the flat of the blade. It is preferable that the bar be spaced from the blade by appropriate spacing means, and that the spacing means and bar provide no surfaces obstructing passage of sawed materials along the working surface of the bar.

In addition to the fact that the round cross-section of the prong in question significantly reduces potential damage to adjacent vegetation during operation of the chain saw having such attachment, the curved second portion of the bar provides a compound angle for receiving and feeding wood or other vegetation being cut through the chain and blade, this portion acting as a cradle. Obviously the size of wood which can be cut will be limited by the curvature of this portion of the bar and, for the device as described herein, it is felt that the optimum design of the bar would be to permit sawing of materials of diameter of two inches or under.

The invention additionally includes a kickback guard consisting of an elongated, rigid member secured to the bar and extending forwardly therefrom. The guard is spaced from the upper front cutting surface of the chain saw and shields that portion of the cutting surface from operative engagement with material to be cut.

It will be understood that materials to be cut can be cradled between the bar and the chain and blade of the saw, when the bar is attached to the flat of the blade, to hold the material steady while it is being cut. At the same time, the bar acts as a stop to prevent unexpected kickback. The direction of rotation of the chain is such that the chain is moving towards the forwardly curved, working surface of the bar in that vicinity. This assists the operator by drawing the material along the bar into proper cutting position during cutting thus enhancing control and safety during cutting and together with the bar, helping to mechanically guide the material. The portion of the bar which projects upwardly and rearwardly beyond the upper edge of the blade may, as required, act as a further cradle to secure materials of small diameter for cutting along this upper edge of the blade, in the V-shaped notch which it makes with the upper edge of the blade.

Since a kickback guard is also provided on the attachment, materials to be cut will be exposed to a cutting surface of the chain near the tip of the blade only in the vicinity near the forwardly curved working surface of the bar. This feature further enhances the safety of the device by permitting the operator of the chain saw to cut with the tip of the saw, where the danger of kickback is greatest, only along the appropriate exposed cutting surface.

BRIEF DESCRIPTION OF THE DRAWINGS

These and other further objects and advantages of the present invention will become apparent upon reading the following detailed description and upon referring to the drawings in which.

In the drawings, similar features have been given similar reference numerals.

DETAILED DESCRIPTION OF THE INVENTION

While the invention will be described in connection with an example embodiment, it will be understood that it is not intended to limit the invention to that embodiment. On the contrary it is intended to cover all alternatives, modifications and equivalents as may be included within the spirit and scope of the invention as defined by the appended claims.

Figure 2:
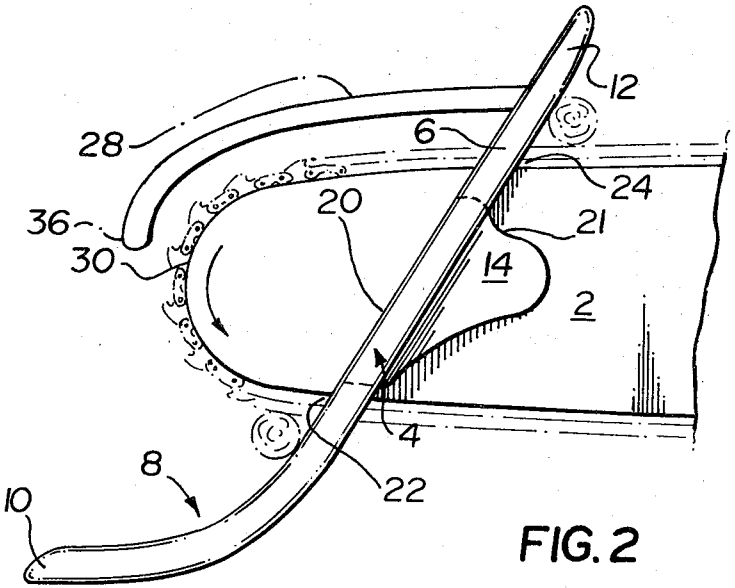
FIG. 2 is a side view of the blade and attachment of FIG. 1.

Turning to FIG. 2 there is shown a standard saw chain guide bar or blade 2 to which bar 4 according to the present invention is attached. In a normal portable chain saw designed for right handed operators the saw chain guide bar is mounted on the right side of the power unit. This enables the operator to cut very close to the ground when the saw is held in the normal felling position. The brush cutting attachment of this invention is desirably fixed on the left hand or upper side of the guide bar when it is viewed from the felling position. This bar may be made of round wire stock or from appropriate stamped, curled metal. A 7.5 mm. diameter has been found an appropriate size for many applications of the attachment according to the present invention.

Bar 4 comprises a first, straight portion 6 which, when secured to the blade 2 extends forwardly and downwardly with respect to the flat of the blade, and at an appropriate angle to the longitudinal axis of the blade (an angle of between about 50° to 60°, as shown, would be suitable). A second portion 8 projects beyond the lower edge of the blade, gradually curved through an arc terminating at end 10, with end 10 in a direction substantially parallel to the longitudinal axis of the blade and located slightly forwardly of the front tip of the blade. The other end 12 of the blade is an extension of first portion 6 of the bar which projects upwardly and rearwardly beyond the upper edge of the blade.

A spacer 14 is positioned between bar 4 and the surface of blade 2 (approximately 6 mm. distance has been found suitable) and the bar and spacer are secured by appropriate means 16 illustrated to be mounting bolts and cooperating nuts.

As can be seen from FIG. 2, the forward surface 20 of spacer 14 is flush with the forward, working surface of the corresponding portion of bar 4 so that no obstruction is provided thereby for materials being cut during operation of the saw. Similarly, the upper edge surface of spacer 14 is curved as shown at 21 to enable continuous, unobstructed passage of cut materials when the upper surface of the blade is being used to cut.

In operation, a twig or branch being cut is normally fitted into lower notch 22 and cradled therein during the cutting operation. As can be seen in FIG. 2, the movement of the chain is towards this notch and consequently, wood or other material being cut is drawn by the chain and guided by the curved end of the bar towards the notch and across the blade during the cutting operation. Moreover it is firmly and safely secured in notch 22 against bar 4 while it is being cut. Similarly, if it is desired to use the upper surface of the blade for cutting, then the material to be cut is drawn to and cradled in notch 24 during the cutting operation. The length of the upper projection is limited to restrict the size of material cut at notch 24. The angle which portion 6 of bar 4 makes with respect to the longitudinal axis of the bar governs the rate at which materials are fed into the saw chain and across the blade. Ends 10 and 12 may be curved as illustrated to assist in positioning the material to be cut within notch 22 or 24. Kickback during cutting, which usually occurs near the tip end of the blade, is significantly reduced particularly when notch 22 is being used by the cradling action of curved portion 8 to secure the chain saw against the material to be cut, and by the extension of bar end 10 beyond the tip of the saw.

As a built-in safety feature of this device, the curvature of portion 6 as well as the location of bar 4 towards the tip end of blade 2 effectively limit or control the size of materials to be cut when using this attachment device, constituting a significant safety feature in that it prevents the device from being used on materials of too large a diameter where problems might arise.

Figure 3:
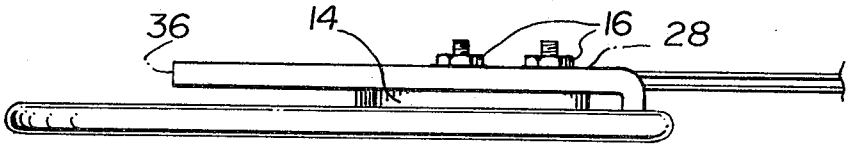
FIG. 3 is a top view of the blade and attachment of FIG. 1.
Figure 1:
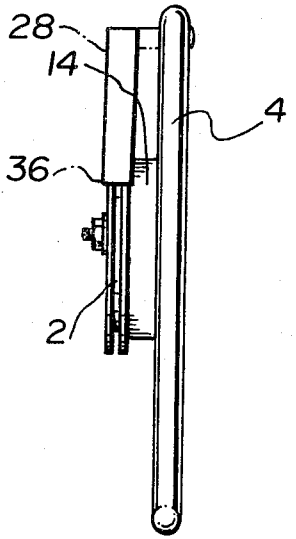
FIG. 1 is a end view of a chain saw blade on which an attachment according to the present invention has been secured.

As illustrated in FIGS. 1 to 3, bar 4 is also provided with a kickback guard 28 comprising an elongated rigid member secured to the bar and extending forwardly therefrom. Guard 28 is spaced from the upper front cutting surface 30 of the guide bar 2 and chain, and has its forward portion 32 curved to lie over a portion of the tip of the blade, terminating at about the longitudinal axis of the blade (see FIG. 2). Guard 28 is preferably spaced along most of its length, a uniform distance from corresponding portions of cutting surface 30, and is spaced a distance and of such a width sufficient to shield that portion of the cutting surface from operative engagement with material to be cut.

In operation, guard 28 ensures that material to be cut with the tip of the chain saw, where kickback danger is greatest, can only be exposed to the cutting surface between the forward tip of the chain saw and the lower, working surface of portion 8 of bar 4 (FIG. 2), clearly minimizing kickback danger.

Thus it is apparent that there has been provided in accordance with the present invention and attachment for a portable direct drive gasoline or electric powered chain saw that fully satisfies the objects, aims and advantages set forth above. While the invention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. An attachment for a direct drive gasoline or electric powered chain saw comprising a rigid bar of round cross-section to be secured to the blade of the chain saw at a point spaced a short distance towards the handle from the tip of the blade, the bar, when so secured substantially lying in a plane parallel to the plane of the blade and having a straight portion traversing the blade at an angle to the longitudinal axis of the blade forwardly and downwardly extending with respect thereto and projecting upwardly and rearwardly in a straight line beyond the upper edge of the blade; the bar having another portion projecting beyond the lower edge of the blade, this other portion being gradually curved through an arc ending in a direction substantially parallel to the longitudinal axis of the blade slightly forwardly of the blade, and means positioned on the bar substantially centrally between its ends to secure the bar to the blade; and comprising, in addition, a kickback guard consisting of an elongated, rigid member secured to the bar and extending forwardly therefrom, to be spaced from the upper front cutting surface of the chain saw and shield that portion of the surface from operative engagement with material to be cut.

2. An attachment according to claim 1 further comprising spacer means secured to the bar to abut against the blade when in secured position and space the bar from the plane of the blade.

3. An attachment according to claim 2 when the forward surface of the spacer means conforms to the front, working surface of the bar so that there is no obstruction to passage of materials being worked upon along the length of the first portion of the bar and the front of the spacing means.

4. An attachment according to claim 1 wherein the bar is made of round wire stock.

5. An attachment according to claim 4 wherein the ends of the bar are curved in the longitudinal direction to form an inwardly beveled beginning of the working surface of the bar.

6. An attachment according to claim 1 wherein the bar is made from stamping and curling flat metal stock.

7. An attachment according to claim 1 wherein the guard at its forward end is curved to lie over a portion of the tip of the blade and terminates at about the longitudinal axis of the blade.

8. An attachment according to claim 1 wherein the guard is formed along most of its length to be spaced a uniform distance from the corresponding portions of the cutting surface of the chain saw.

9. An attachment according to claim 8 wherein the guard is of a width about the same as the thickness of the chain saw blade.

10. An attachment according to claim 1 wherein the guard is secured to the bar at a point along its upward and rearward extension.

11. A chain saw including a blade, chain and handle, to which is secured an attachment according to claim 1 at a point spaced a short distance towards the handle from the tip of the blade, the attachment lying substantially in a plane parallel to that of the blade, the straight portion of the attachment bar traversing the flat of the blade at an angle to the longitudinal axis of the blade forwardly and downwardly extending with respect to the blade and projecting upwardly and rearwardly beyond the upper edge of the blade, the curved portion of the bar projecting beyond the lower edge of the blade.

12. A chain saw according to claim 11 wherein the attachment bar traverses the blade at an angle of about 50° to 60° to the longitudinal axis.

13. A chain saw according to claim 11 wherein the attachment bar is fixed on the upper side of the blade when in felling position.

14. A chain saw according to claim 11 wherein the guard at its forward end is curved and lies over a portion of the tip of the blade, terminating at about the longitudinal axis of the blade.

15. A chain saw according to claim 11 wherein the guard is spaced a uniform distance along most of the its length from corresponding portions of the cutting surface of the chain saw.

16. A chain saw according to claim 15 wherein the guard is of a width about the same as the thickness of the chain saw blade.

17. A chain saw according to claim 11 wherein the guard is secured to the bar at a point along its upward and rearward extension.

* * * * *